US009175563B2

(12) United States Patent
Attarde et al.

(10) Patent No.: US 9,175,563 B2
(45) Date of Patent: Nov. 3, 2015

(54) COMBINED MOTOR AND BRAKE WITH ROTATING BRAKE-RELEASE PISTON

(71) Applicant: Eaton Corporation, Cleveland, OH (US)

(72) Inventors: Trimbak S. Attarde, Pune (IN); Hrishikesh N. Thakur, Maharashtra (IN); Jay Paul Lucas, Plymouth, MN (US)

(73) Assignee: Eaton Corporation, Cleveland, OH (US)

( * ) Notice: Subject to any disclaimer, the term of this patent is extended or adjusted under 35 U.S.C. 154(b) by 100 days.

(21) Appl. No.: 13/944,405

(22) Filed: Jul. 17, 2013

(65) Prior Publication Data

US 2014/0023543 A1 Jan. 23, 2014

Related U.S. Application Data

(60) Provisional application No. 61/672,979, filed on Jul. 18, 2012.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F01C 21/00*** | (2006.01) |
| ***F03C 2/08*** | (2006.01) |
| ***F04C 15/00*** | (2006.01) |

(52) U.S. Cl.

CPC ..... *F01C 21/008* (2013.01); *F03C 2/08* (2013.01); *F04C 15/0084* (2013.01)

(58) Field of Classification Search

USPC ..... 418/61.3, 69, 166, 171; 188/71.5, 188/72.1–72.3, 166, 170

See application file for complete search history.

(56) References Cited

U.S. PATENT DOCUMENTS

| | | | | |
|---|---|---|---|---|
| 4,187,931 | A | 2/1980 | Balzer | |
| 4,645,039 | A | 2/1987 | Lewis et al. | |
| 4,667,527 | A | 5/1987 | Ehrlinger et al. | |
| 4,736,821 | A * | 4/1988 | Ries | 188/71.6 |

(Continued)

FOREIGN PATENT DOCUMENTS

| | | | |
|---|---|---|---|
| DE | 100 22 758 | A1 | 11/2000 |
| EP | 1 072 791 | A2 | 1/2001 |

(Continued)

OTHER PUBLICATIONS

International Search Report and Written Opinion for PST/US2013/050807 mailed Jun. 17, 2014.

*Primary Examiner* — Theresa Trieu

(74) *Attorney, Agent, or Firm* — Merchant & Gould P.C

(57) ABSTRACT

The present disclosure relates to a combined hydraulic motor and brake including a hydraulic motor having a hydraulic motor housing, a drive shaft assembly that is driven by the hydraulic motor, a stationary housing that is fixed relative to the hydraulic motor housing, and a rotatable housing that is rotatably driven by the drive shaft assembly. The combined hydraulic motor and brake also includes a brake for resisting relative rotation between the rotatable housing and the stationary housing, and a piston that is hydraulically actuated to release the brake. The piston is carried with the rotatable housing such that the piston, the rotatable housing and at least a portion of the drive shaft assembly are configured to rotate as a unit.

24 Claims, 9 Drawing Sheets

(56) References Cited

U.S. PATENT DOCUMENTS

| | | | | |
|---|---|---|---|---|
| 4,981,423 | A | 1/1991 | Bissonnette | |
| 5,836,231 | A | 11/1998 | Leinonen | |
| 6,132,194 | A | 10/2000 | Wenker et al. | |
| 6,253,882 | B1 * | 7/2001 | White | 188/71.5 |
| 6,321,882 | B1 | 11/2001 | Heckel et al. | |
| 6,743,002 | B1 | 6/2004 | Millar et al. | |
| 6,772,863 | B2 | 8/2004 | Jessen et al. | |
| 7,014,028 | B2 | 3/2006 | Buck et al. | |
| 7,287,969 | B2 | 10/2007 | Fugle | |
| 2004/0060779 | A1 | 4/2004 | Kreger | |
| 2006/0159581 | A1 * | 7/2006 | Fugle | 418/61.3 |
| 2008/0307784 | A1 | 12/2008 | White, Jr. | |
| 2010/0178188 | A1 | 7/2010 | White, Jr. | |
| 2011/0017059 | A1 | 1/2011 | Heren et al. | |

FOREIGN PATENT DOCUMENTS

| | | |
|---|---|---|
| GB | 1 441 173 | 6/1976 |
| WO | WO 2007/083232 A2 | 7/2007 |

* cited by examiner

COMBINED MOTOR AND BRAKE WITH ROTATING BRAKE-RELEASE PISTON

CROSS REFERENCE TO RELATED APPLICATION

The present application claims priority to U.S. Provisional Patent Application Ser. No. 61/672,979, entitled "Combined Motor And Brake With Rotating Brake-Release Piston" and filed on Jul. 18, 2012, the disclosure of which is hereby incorporated by reference in its entirety.

TECHNICAL FIELD

The disclosure is directed to hydraulic motor and braking assemblies.

BACKGROUND

In many propel-vehicle applications that include hydraulic motors, it is desirable for the motor to have a parking brake or parking lock. Typically, brake packages which are used with hydraulic motors, and especially those brake packages used as integral brake packages with low-speed, high-torque (LSHT) gerotor motors, are of the "spring-applied, pressure-released" (SAPR) type as is now well known to those skilled in the art. In a typical SAPR braking assembly, the braking members (e.g., friction discs, etc.) are biased toward braking engagement by a spring arrangement, and are moved toward a brake-disengaged condition by hydraulic pressure, which may be internal case pressure, external "pilot" pressure from a system charge pump, or any other suitable source of pressure.

In most embodiments, a SAPR braking assembly utilizes a piston to apply or release a brake. The piston transfers force from a spring to a brake pack (e.g., a plurality of brake pads) to engage the brake assembly. The piston utilized to apply or release the brake is generally enclosed between a stationary housing and a rotating shaft, or between two stationary housings (see, e.g., U.S. Pat. No. 6,743,002). The inner and outer diameters of the piston are usually sealed by one or more seals, which may be dynamic or static. For instance, a seal on an outer diameter of the piston may be a static seal, while the seal on an inner diameter of the piston may be a dynamic seal or a static seal, depending on whether the piston is seated on a rotating shaft or a stationary housing. Due to the dimensional variations inherent in dynamic seals, these types of seals can be difficult and costly to design, and can wear out more quickly than static seals. Because of these design and wear constraints, dynamic seals are generally only suitable for small rotating shaft diameters. As shaft diameter increases, the pressure velocity (PV) factor for the seal increases, thus limiting the seal life and the size of a piston inner diameter.

SUMMARY

Aspects of the present disclosure relate to a hydraulic motor and brake assembly having a piston released brake pack. The piston is configured to rotate in unison with rotating components of the assembly such that inner and outer seals of the piston remain static as the components are rotated. In one embodiment, the components include a rotating housing adapted for connection to a wheel or gear, and a drive shaft assembly for rotating the rotating housing and the piston relative to a stationary housing. In one embodiment, the inner seal engages the drive shaft assembly and the outer seal engages the rotating housing.

Another aspect of the present disclosure relates to a combined hydraulic motor and brake including a hydraulic motor having a hydraulic motor housing, a drive shaft assembly that is driven by the hydraulic motor, a stationary housing that is fixed relative to the hydraulic motor housing, and a rotatable housing that is rotatably driven about an axis of rotation by the drive shaft assembly. The combined hydraulic motor and brake also includes a brake for resisting relative rotation between the rotatable housing and the stationary housing, and a piston that is hydraulically actuated to release the brake. The piston is carried with the rotatable housing such that the piston, the rotatable housing and at least a portion of the drive shaft assembly are configured to rotate as a unit about the axis of rotation.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

The accompanying drawings, which are incorporated in and constitute a part of the description, illustrate several aspects of the present disclosure. A brief description of the drawings is as follows.

DETAILED DESCRIPTION

Figure 1:
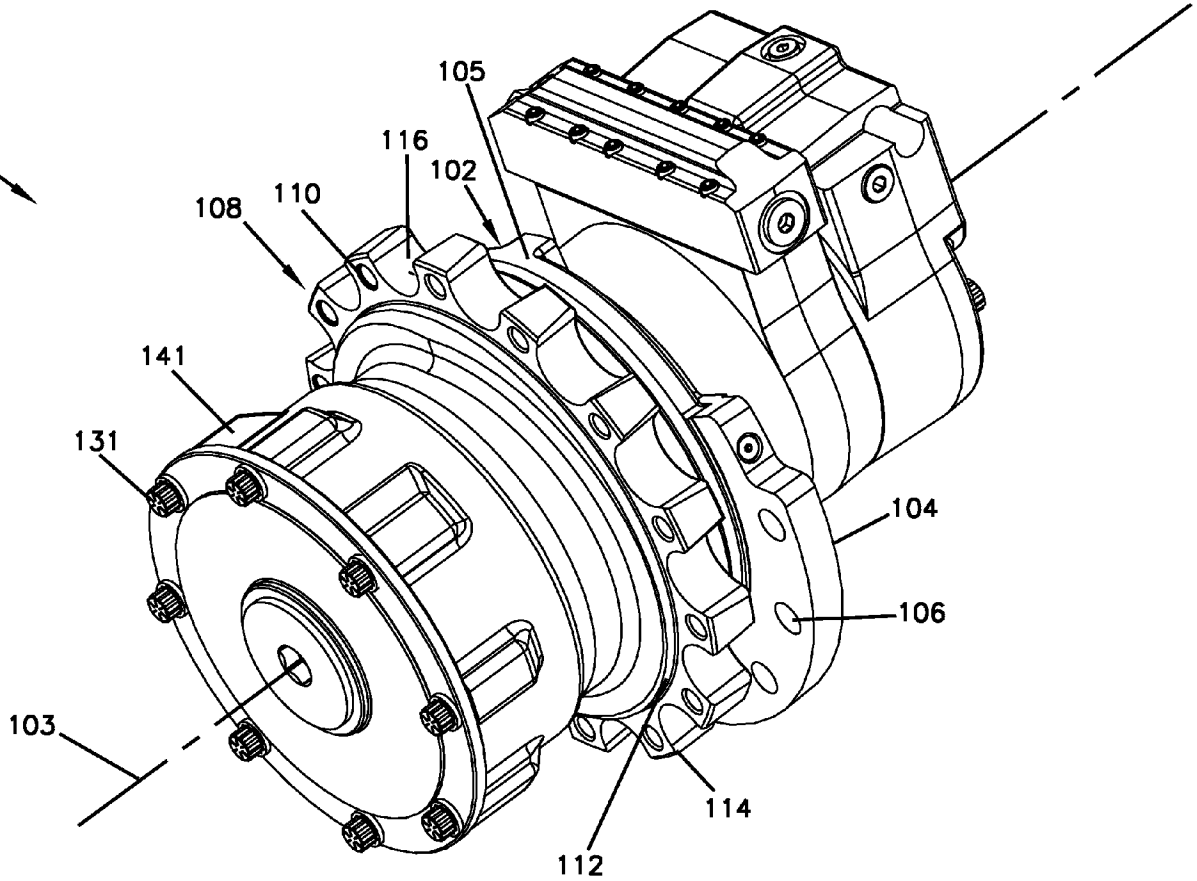
FIG. 1 is an isometric view of a combined hydraulic motor and brake having exemplary features in accordance with the principles of the present disclosure.

Reference will now be made in detail to the exemplary aspects of the present disclosure that are illustrated in the accompanying drawings. Wherever possible, the same reference numbers will be used throughout the drawings to refer to the same or like structure. Embodiments of the disclosure described above may be particularly useful in propel vehicle applications, such as compact track loaders, sprayers, combines or other low speed, high torque vehicles. One or more combined hydraulic motor and brake assemblies may be coupled to a track, a wheel or a sprocket/gear driving a track.

Hydraulic motor and brake assemblies in accordance with the principles of the present disclosure can also be used to drive chipping/grinding drums, chipping/grinding wheels or discs, drill heads, or other rotatable structures.

Generally disclosed is a motor and brake assembly. The assembly may include a hydraulic motor that drives rotation of a driven hub to which a driven element such as a wheel, sprocket drum or other structure can be mounted/connected. Torque from the hydraulic motor can be transferred to the driven hub by a shaft assembly including a drive shaft and a coupler. The coupler is configured to couple the drive shaft to the driven hub. The motor and brake assembly can also include a brake piston carried with the coupler and the driven hub such that these components rotate together as a unit. An outer diameter of the brake piston may be frictionally engaged with the driven hub and an inner diameter of the brake piston may be frictionally engaged with the shaft assembly (e.g., the coupler or the drive shaft). The brake piston may include one or more seals which are not exposed to relative rotational movement between the parts being sealed as the driven hub is rotated. For example, an outer seal can be provided between the brake piston and the driven hub and an inner seal can be provided between the brake piston and the drive shaft or the coupler. Since the brake piston, the driven hub, the drive shaft and the coupler all rotate as a unit, there is no relative movement between the seals and the components being sealed by the seals (i.e., the seals remain static/stationary with respect to the components being sealed). This reduces wear on the seals and enhances piston and overall assembly size flexibility. A brake pack is used to provide a braking action for resisting relative rotation between the driven hub and a stationary housing of the assembly. The stationary housing can be adapted to be coupled to a structure such as a vehicle frame. The brake pack can include first brake pads carried with the driven hub and second brake pads secured to the stationary housing. The first and second brake pads can be interleaved with one another. To apply the brake, the piston compresses the first and second brake pads together such that friction between the pads resists relative rotation between the driven hub and the stationary housing. A spring can be used to bias the brake piston against the brake pack thereby providing a braking force that causes application of the brake. A brake release mechanism is configured to move the brake piston away from the brake pack to release the braking force. The brake release mechanism can be hydraulically actuated.

Figure 2:
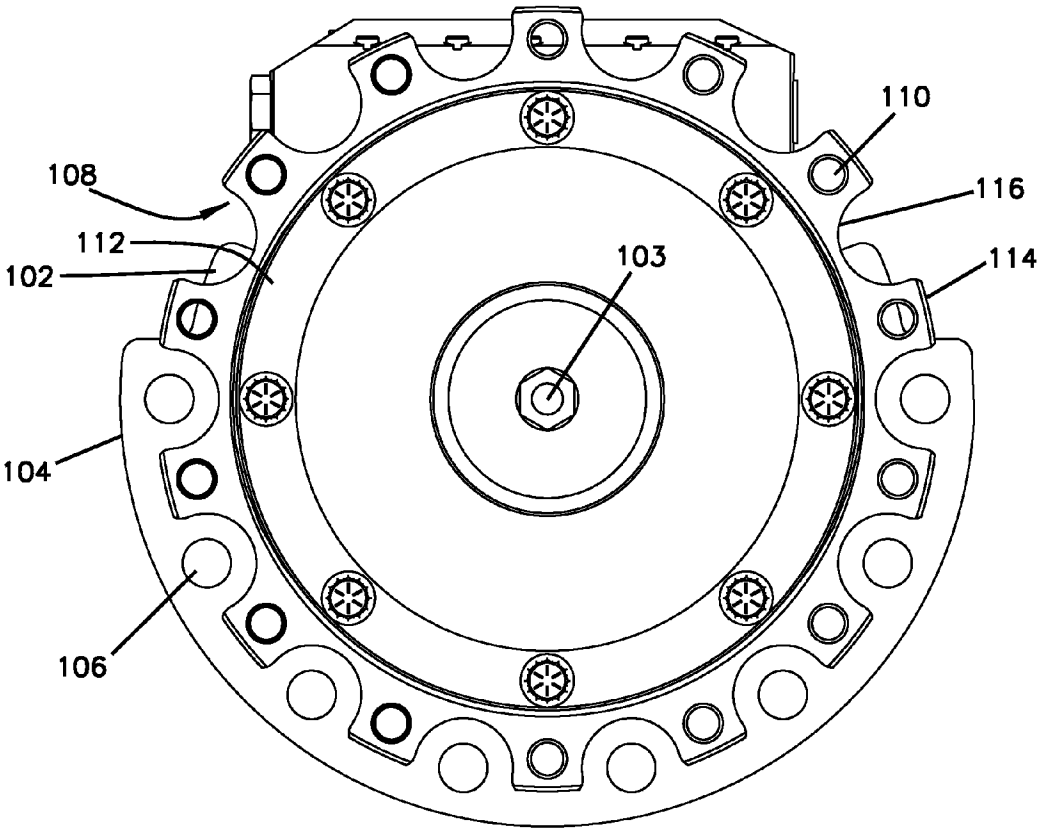
FIG. 2 is a front view of the combined hydraulic motor and brake of FIG. 1.

Referring to FIGS. 1-9, a combined hydraulic motor and brake assembly 100 may generally include a first mounting assembly for coupling the combined hydraulic motor and brake assembly 100 to a non-driven/stationary element (e.g., a portion of a vehicle frame 200). For the purposes of this disclosure, the first mounting assembly may include a stationary housing 102. The stationary housing 102 can also be referred to as an inner housing. The stationary housing 102 includes a mounting flange 104 projecting radially outwardly from a main body 105 of the stationary housing 102. The mounting flange 104 defines a plurality of first fastener openings 106 for receiving first fasteners (e.g., bolts not shown) used to secure the stationary housing 102 to a non-driven/stationary element. The mounting flange 104 is generally semi-circular in shape, but other shapes could be used as well (e.g., full rings or other shapes). The combined hydraulic motor and brake assembly 100 may also include a second mounting assembly for coupling the combined hydraulic motor and brake assembly 100 to a driven/non-stationary element (e.g., a wheel, sprocket or other structure intended to be rotated). For the purposes of this disclosure, first mounting assembly may include a driven hub 108. The driven hub 108 can also be referred to as an outer housing or a rotating housing. The driven hub 108 may be mounted at least partially over the stationary housing 102. The driven hub 108 includes a plurality of second fastener openings 110 for receiving second fasteners (e.g., bolts not shown) used to secure the driven hub 108 to a driven element. The driven hub 108 includes a main body 112 and a plurality of tabs 114 that project radially outwardly from the main body 112. The tabs 114 are circumferentially spaced around a perimeter of the main body 112 of the driven hub 108. The second fastener openings 110 may be defined through the tabs 114. The tabs 114 are separated by pockets 116, and at least some of the pockets 116 may align with the first fastener openings 106 to facilitate accessing the first fastener openings 106. FIG. 2 illustrates the pockets 116 aligned with the first fastener openings 106. In other embodiments, configurations other than tabs (e.g., solid flanges or other structures) can be used to connect the driven hub to a driven element.

Figure 6:
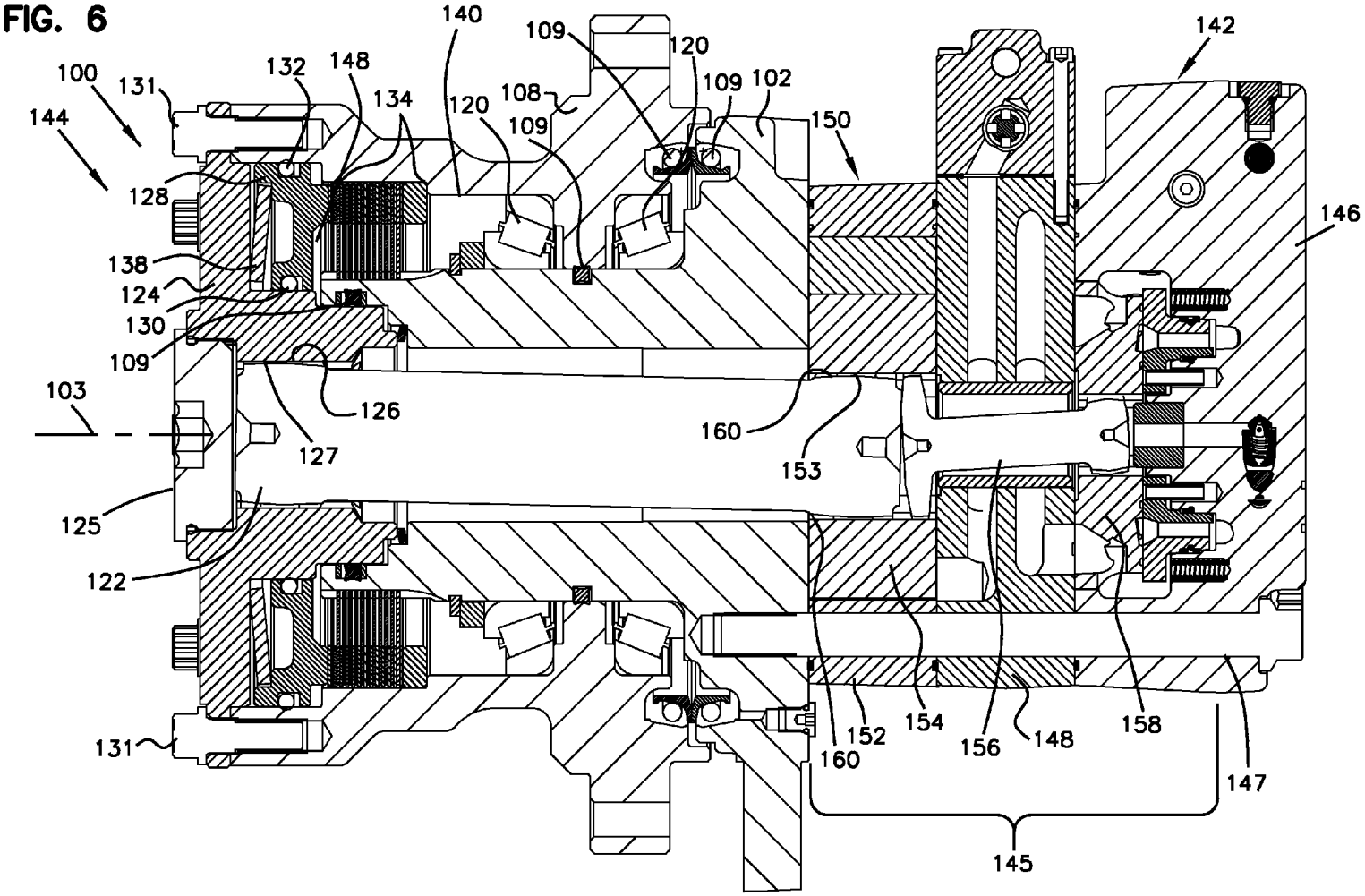
FIG. 6 is a cross-sectional view of a combined hydraulic motor and brake illustrating in further detail the motor portion of the hydraulic motor and brake of FIG. 1.

Referring to FIG. 6, a cross-sectional view of the combined hydraulic motor brake assembly 100 is shown. As discussed above, the combined hydraulic motor and brake assembly 100 includes a stationary housing 102 and a driven hub 108. A sealing arrangement 109 (e.g., duo cone seals, X-ring seals, O-ring seals, etc.) may be disposed between stationary housing 102 and the driven hub 108 at various intervals. Stationary housing 102 may further define a shaft passage 118. One or more bearings 120 may be positioned between the driven hub 108 and the stationary housing 102 to allow the driven hub 108 to rotate relative to the stationary housing 102 about an axis of rotation 103 that extends through the shaft passage 118. The axis of rotation 103 is defined by the bearings 120. Any suitable bearing may be utilized. In some embodiments, the bearing 120 is a thrust bearing. The combined hydraulic motor and brake assembly 100 further includes a main drive shaft 122 that extends through the shaft passage 118 of the stationary housing 102.

The combined hydraulic motor and brake assembly 100 may further include a coupler 124 for coupling the main drive shaft 122 to the driven hub 108. The coupler 124 and the driven hub 108 rotate as a unit about the axis of rotation 103 when driven by the drive shaft 122. The coupler 124 is coupled to the driven hub 108 by a plurality of fasteners 131 (e.g., bolts, cams, etc.) that are circumferentially spaced around the axis of rotation 103 along a perimeter of the coupler 124. The main drive shaft 122 is coupled to the coupler 124 by a splined mechanical interface (e.g., a crown spline interface). Specifically, an end of drive shaft 122 includes splines 126 that engage with splines 127 of coupler 124. Torque may be transferred from main drive shaft 122 to coupler 124 and the driven hub 108 as main drive shaft 122 is driven (e.g., by a hydraulic motor). An end plug 125 (see FIG. 6) mounts to the coupler 24 and encloses the end of the shaft passage 118. The end plug 125 can be threaded in the coupler 124 and can oppose an end of the drive shaft 122 in the shaft passage 118.

FIG. 6 shows a motor portion (e.g., hydraulic motor 142) and a brake portion (e.g., brake assembly 144) of the hydraulic motor and brake of FIG. 1. The hydraulic motor 142 is configured to rotate the main drive shaft 122 relative to the stationary housing 102. In the depicted embodiment, the motor is rear-piloted, and includes a motor housing assembly 145 back-mounted to the stationary housing 102 via fasteners 147. In this way, the stationary housing 102 is fixed or stationary relative to the motor housing assembly 145. Other types of motor piloting and motor mounting configurations can be used as well.

The hydraulic motor 142 includes an end cap 146 which may define one or more fluid inlet and outlet ports, as will be discussed further with reference to FIGS. 7-9. In preferred embodiments, the motor 142 is a gerotor-type hydraulic motor. Disposed adjacent the end cap 146 is a port plate 148, and adjacent thereto (moving "forwardly", or to the left in FIG. 6) is a fluid displacement mechanism which, in the subject embodiment, comprises a gerotor assembly, generally designated 150. As is well known in the art, the gerotor assembly 150 may include a stator (e.g., an outer gear 152), which may be an internally-toothed ring member, and disposed therein, a rotor (e.g., an inner gear 154), which may be an externally-toothed star member, which undergoes orbital and rotational movement in response to pressurized fluid being communicated from an inlet port to one or more motor chambers. In such embodiments, the main drive shaft 122 is coupled to the inner gear 154 (e.g., by a splined connection). Rotation of the inner gear 154 within the outer gear 152 drives rotation of the shaft 122 about its central axis and also cause the shaft 122 to orbit about the central axis 103. It will be appreciated that the term "rotation" includes pure rotation as well as eccentric or wobbling type rotation. The inner gear 154 is also coupled to a secondary shaft 156 (e.g. a valve drive shaft). The rotational movement of the inner gear 154 is transmitted by means of the secondary shaft 156 to a rotatable disk member 158. As is also well known to those skilled in the art, the function of the rotatable disk member 158 is to control the communication of pressurized fluid from an inlet port to the gerotor gear set 150, and to control the communication of low pressure, exhaust fluid from the gerotor gear set 150 to an outlet port. Gerotor-type hydraulic motors can also include rollers in place of internal gear teeth that prevent direct contact between the rotor and the stator. Thus, Geroler® type hydraulic geroler motors sold by Eaton Corporation are considered gerotor-type hydraulic motors for the purposes of this disclosure. While gerotor-type hydraulic motors are preferred, other types of hydraulic motors can be used as well.

Figure 3:
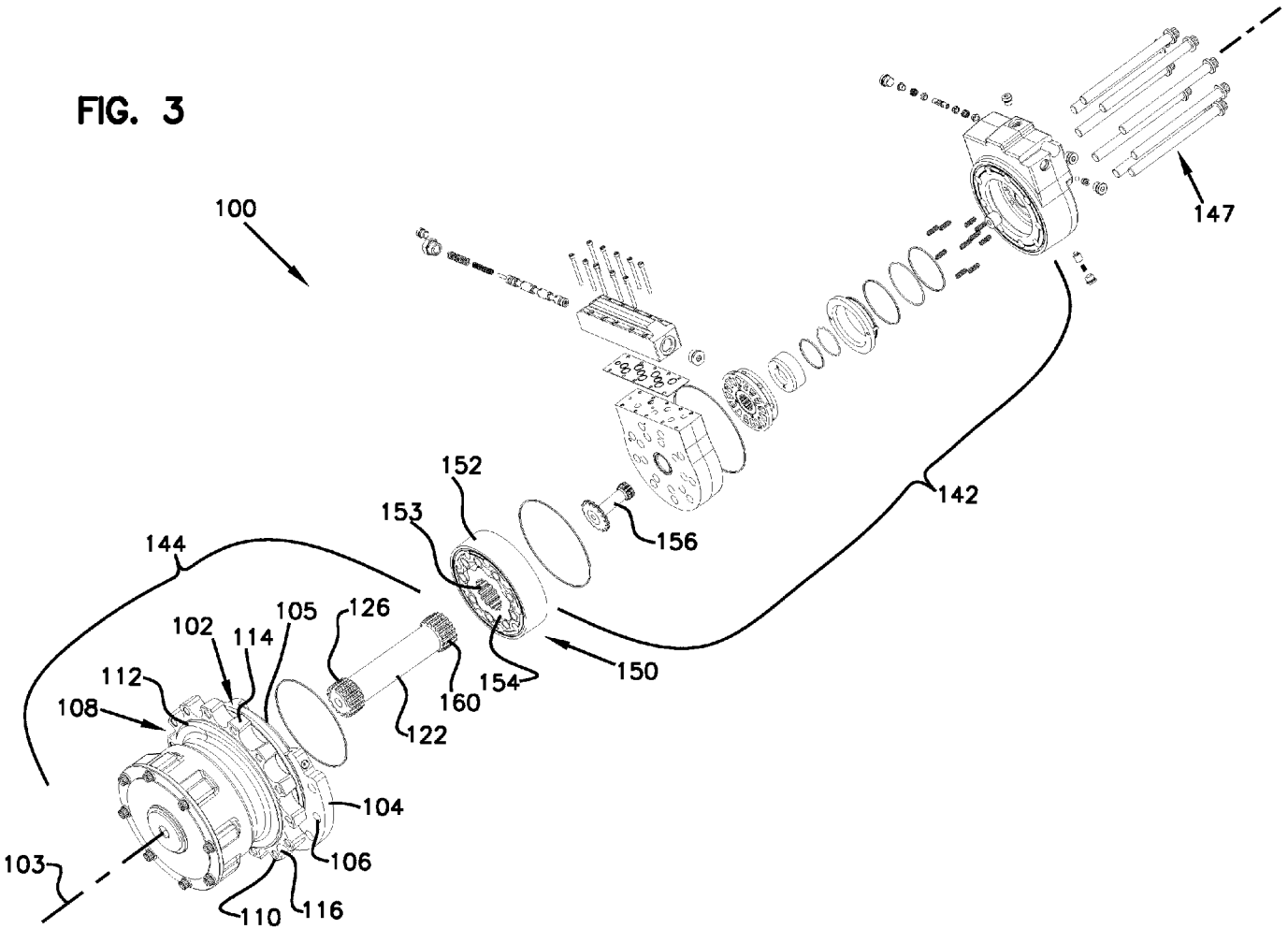
FIG. 3 is an isometric view of exemplary components of the combined hydraulic motor and brake of FIG. 1.
Figure 4:
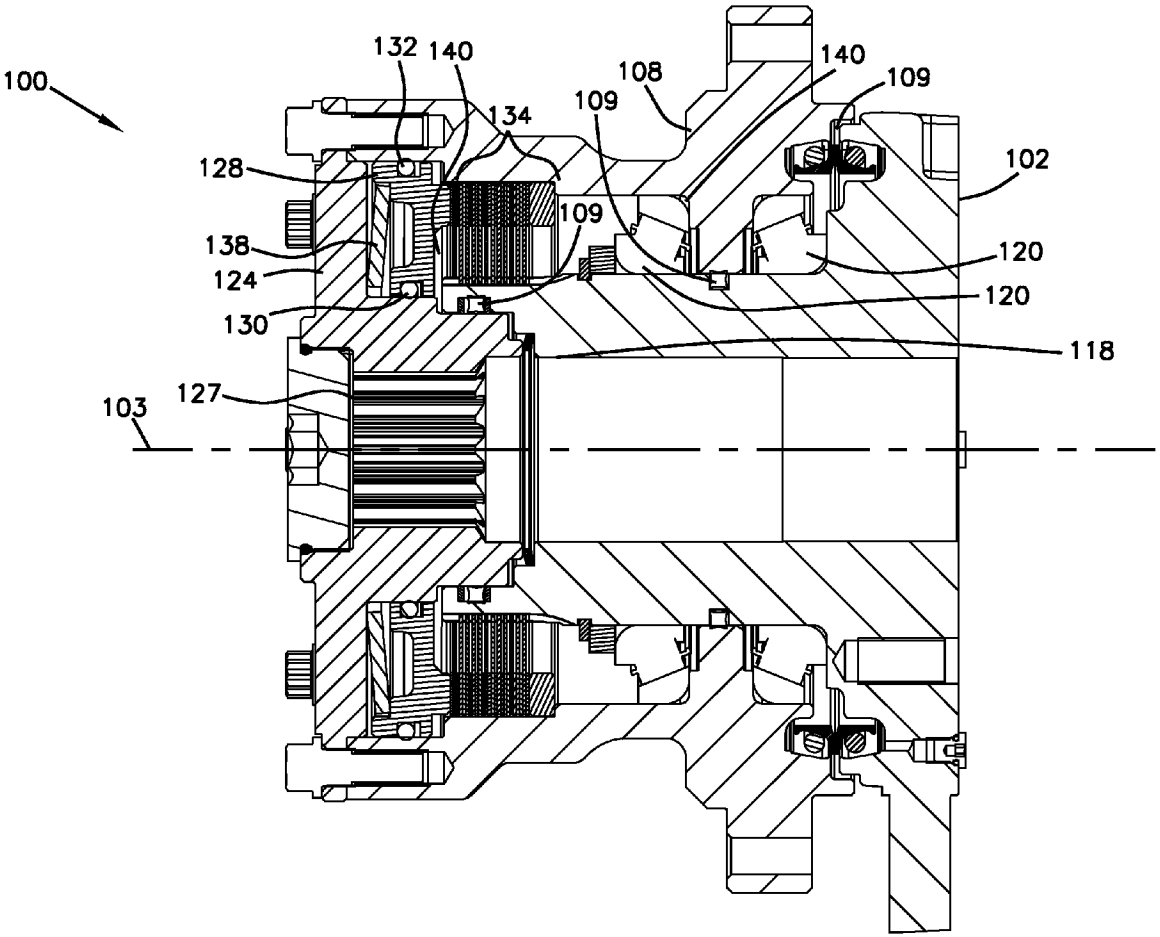
FIG. 4 is a cross-sectional view of a portion of the combined hydraulic motor and brake of FIG. 1.

Referring to FIGS. 3 and 6, the inner gear 154 of the motor 142 is in splined engagement with the main drive shaft 122. For example, the main drive shaft 122 has a rearward set of crowned splines 160 in splined engagement with internal splines 153 in the inner gear 154. The main drive shaft 122 also includes a forward set of crowned splines (e.g., splines 126 of FIG. 4) in splined engagement with internal splines 127 of coupler 124. The forward splines 126 of the main drive shaft 122 mate with the coupler splines 127 to affect torque transfer between the main drive shaft 122 and the coupler 124. One or more of the spline assemblies may be chamfered or beveled to aid in dynamic spline engagement.

The brake portion 144 of the combined hydraulic motor and brake assembly 100 includes a brake piston 128. The piston 128 may be a lock piston as is known in the art. The piston 128 may frictionally engage with and be carried with the coupler 124 and the driven hub 108, thus rotating when the coupler 124 and the driven hub 108 are rotated about the axis of rotation 103 by the main drive shaft 122. The piston 128 may include a plurality of sealing arrangements to prevent fluid leakage. Sealing arrangements may be disposed between the piston 128 and one or more other components of assembly 100. A first sealing arrangement may be located at an inside surface of the piston (e.g., to seal a piston inner diameter). For example, an inner radial piston seal 130 may be positioned between the piston 128 and the coupler 124 for frictionally engaging the piston 128 and the coupler 124. A second sealing arrangement may be located at an outside surface of the piston 128 from the first sealing arrangement (e.g., to seal a piston outer diameter). For example, an outer radial piston seal 132 may be positioned between the piston 128 and the driven hub 108 for frictionally engaging the piston 128 and the driven hub 108. Inner radial piston seal 130 and outer radial piston seal 132 may comprise any suitable sealing means for sealing piston 128. For example, each sealing arrangement may include one or more O-rings, X-rings, duo cone rings or other appropriate sealing structures. Seals may be constructed to be static or dynamic seals. However, regardless of seal-type utilized, inner radial piston seal 130 and outer radial piston seal 132 effectively become static seals when piston 128 rotates with the coupler 124 and the driven hub 108. Thus, piston seal life may improve and design flexibility may increase, as both piston seals are effectively static when the driven hub 108 rotates.

Figure 5:
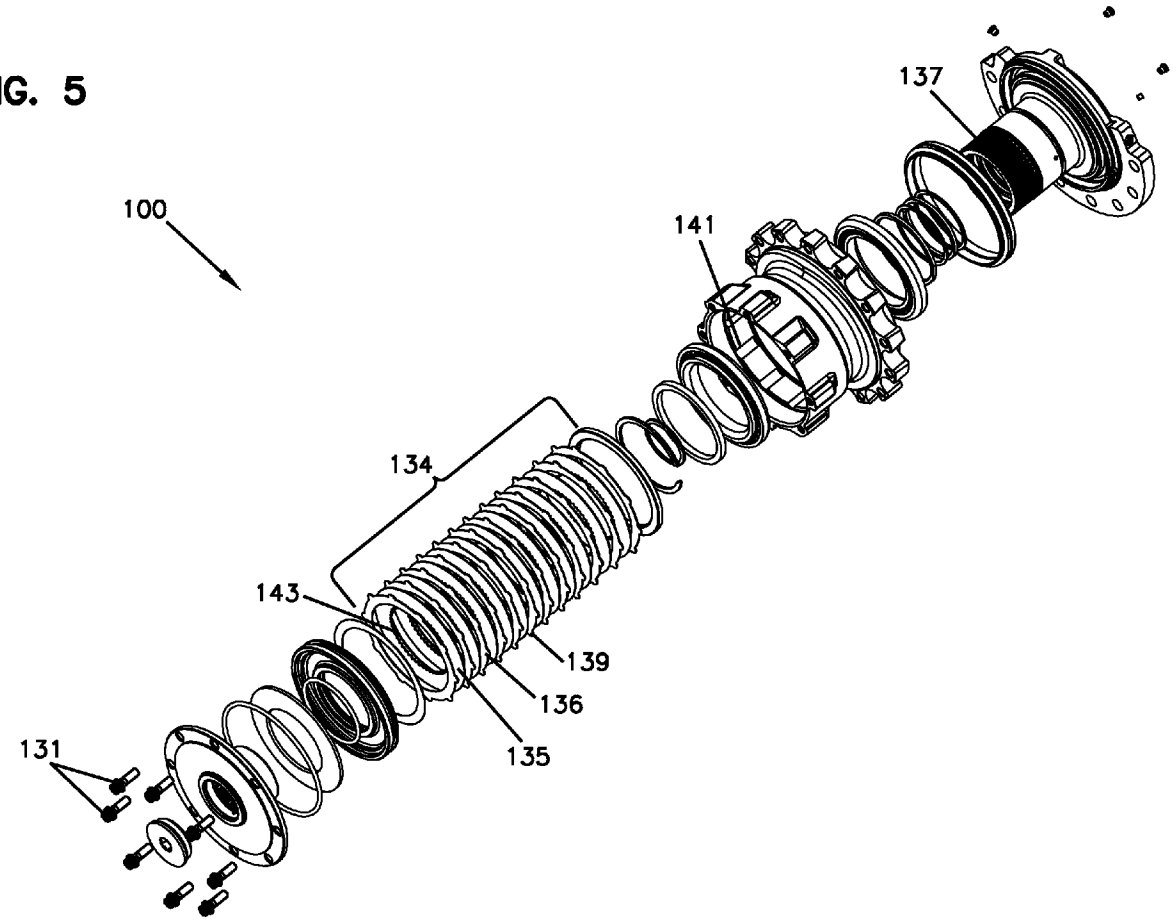
FIG. 5 is an isometric view of exemplary components of FIG. 4 including a brake pack suitable for use in the combined hydraulic motor and brake of FIG. 1.

The brake portion 144 of the combined hydraulic motor and brake assembly 100 also includes a brake disc assembly, or brake pack 134. FIG. 5 is an exploded isometric view of brake pack components according to embodiments of the disclosure. When the brake pack is compressed, relative rotation is not allowed between the driven hub 108 and stationary housing 102. Brake pack 134 may include first brake pads 135 mounted to the stationary housing 102 and second brake pads 136 carried by the driven hub 108 such that the second brake pads 136 rotate relative to the first brake pads 135 when the driven hub 108 rotates relative to the stationary housing 102. The first and second brake pads 135, 136 are interleaved relative to one another. A plurality of serrations 143 may be disposed on at least a portion of the interior diameter of the first brake pads 135. The serrations 143 engage with corresponding serrations 137 on the stationary housing 102 to limit relative rotation between the first brake pads 135 and the stationary housing 102. A plurality of tabs 139 may be disposed on outer diameters of the second brake pads 136. The tabs 139 fit within corresponding tab slots 141 defined by the driven hub 108 to limit relative rotation between the driven hub 108 and the second brake pads 136.

Referring back to FIG. 4, the brake assembly 144 of the combined hydraulic motor and brake assembly 100 includes a spring assembly 138 for actuating the brake pack 134. In some embodiments, spring assembly 138 may include a series of concentric springs. Concentric springs may be a plurality of conical disc shaped springs or washers located adjacent to one another. A first set of conical washers may be oriented in a first direction opposite to a second direction associated with a second set of conical washers. In one embodiment, spring assembly 138 comprises one or more Belleville washers or springs arranged in the described configuration.

The spring assembly 138 may be located between the piston 128 and the coupler 124. An area between the piston 128 and the coupler 124 may be defined as a spring chamber. The spring assembly 138 is compressed between the coupler 124 and the piston 128 such that the spring assembly is preloaded with a spring force. To engage the brake, the spring assembly 138 is configured to normally urge the piston 128 against the brake pack 134. Piston 128 may normally be biased to the right by the force of spring assembly 138 thereby compressing brake pack 134. According to the embodiments described herein, spring assembly 138 may actuate the brake pack 134 by applying a braking force through the piston 128 to the brake pack 134 to compress the first and second brake pads 135, 136 together such that relative rotation between the driven hub 108 and stationary housing 102 is resisted by friction between the first and second brake pads 135, 136. When the brake pack 134 is compressed, relative rotation between driven hub 108 and stationary housing 102 is resisted or prevented. To release the brake, a brake release mechanism is configured to urge the piston 128 away from the brake pack 134 to decrease the braking force. The brake release mechanism may comprise hydraulic fluid, pneumatic pressure or mechanical means that applies an opposite force against the piston 128, to counteract the spring force of the spring assembly 138. The combined hydraulic motor and brake assembly 100 may include a brake chamber 140 formed on the brake pad side of the piston 128 (i.e., the side opposite the spring assembly 138). To release the brake, brake chamber 140 may be pressurized. Brake chamber 140 may be sealed with one or more O-rings, X-rings or any other suitable sealing means. When the brake is released, rotation of the driven hub 108, coupler 124, piston 128, second brake pads 136 and spring assembly 138 relative to the stationary housing 102 is permitted. In certain embodiments, the chamber 140 is pressurized by placing the chamber 140 in fluid communication with a pilot/charge pressure of the hydraulic circuit powering the hydraulic motor 142.

Figure 7:
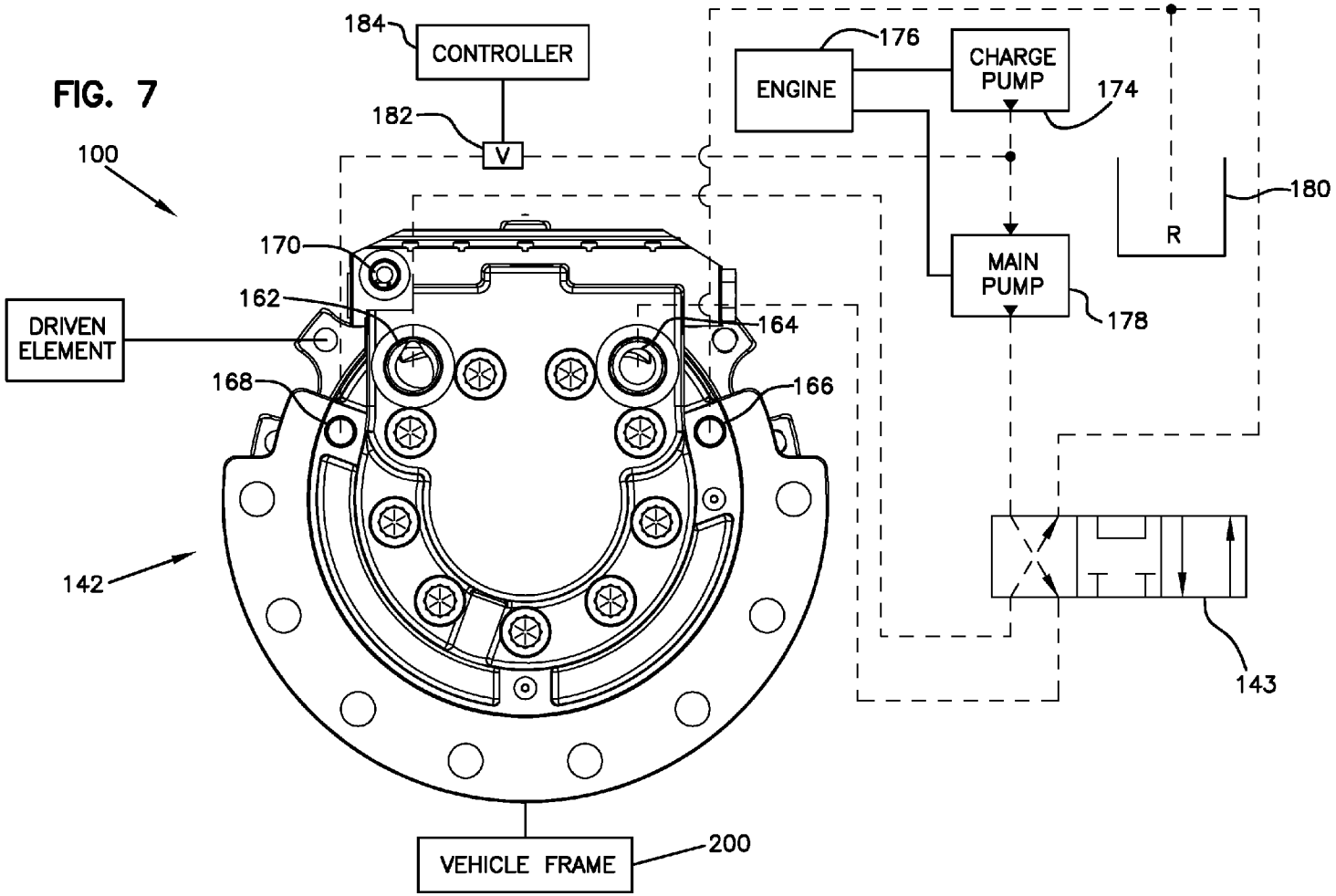
FIG. 7 is a combined schematic illustration of an exemplary combined hydraulic motor and brake implemented with a vehicle and a back view of a combined hydraulic motor and brake.
Figure 8:
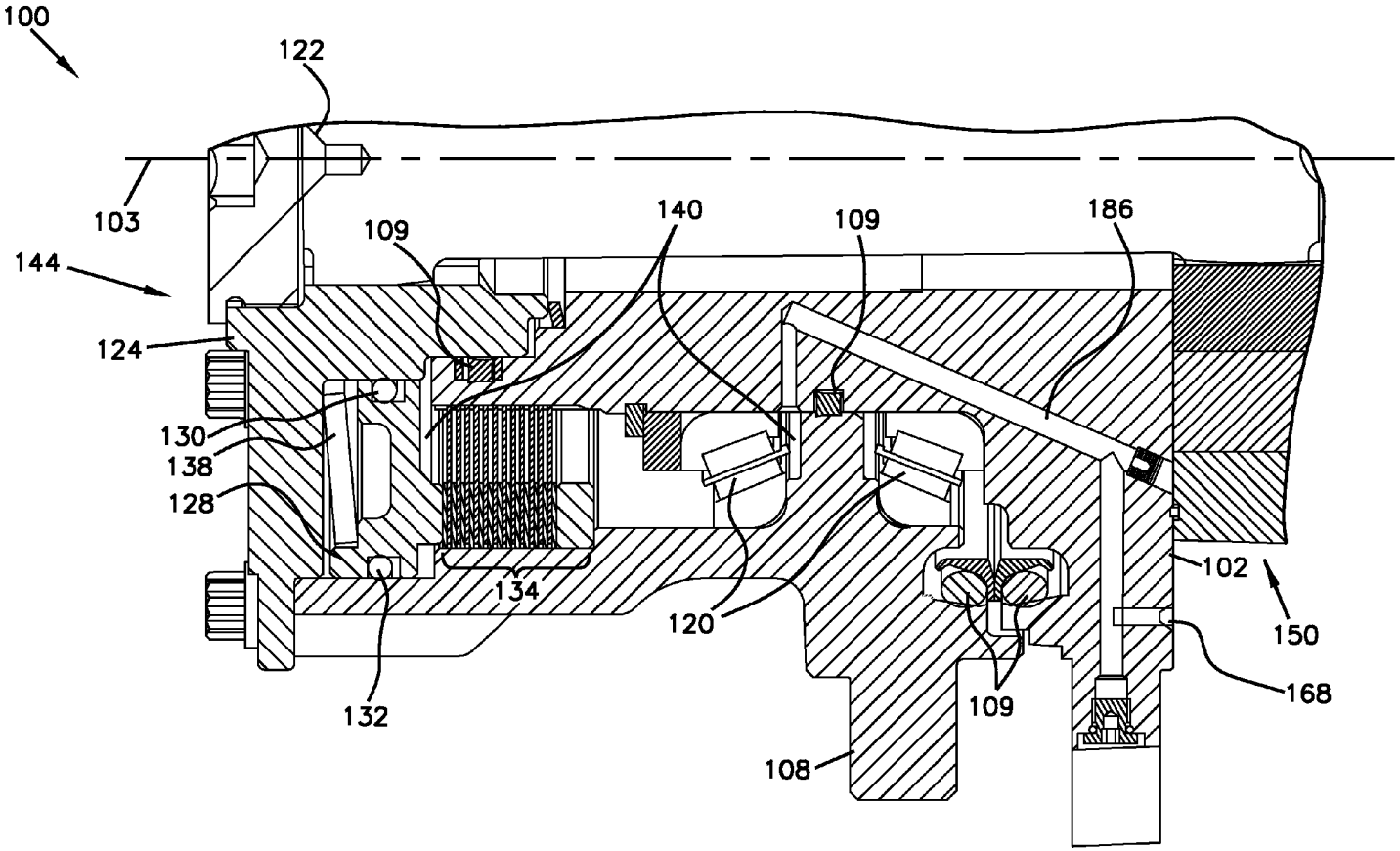
FIG. 8 is a cross-sectional view of a brake release cavity of the combined hydraulic motor and brake of FIG. 1.
Figure 9:
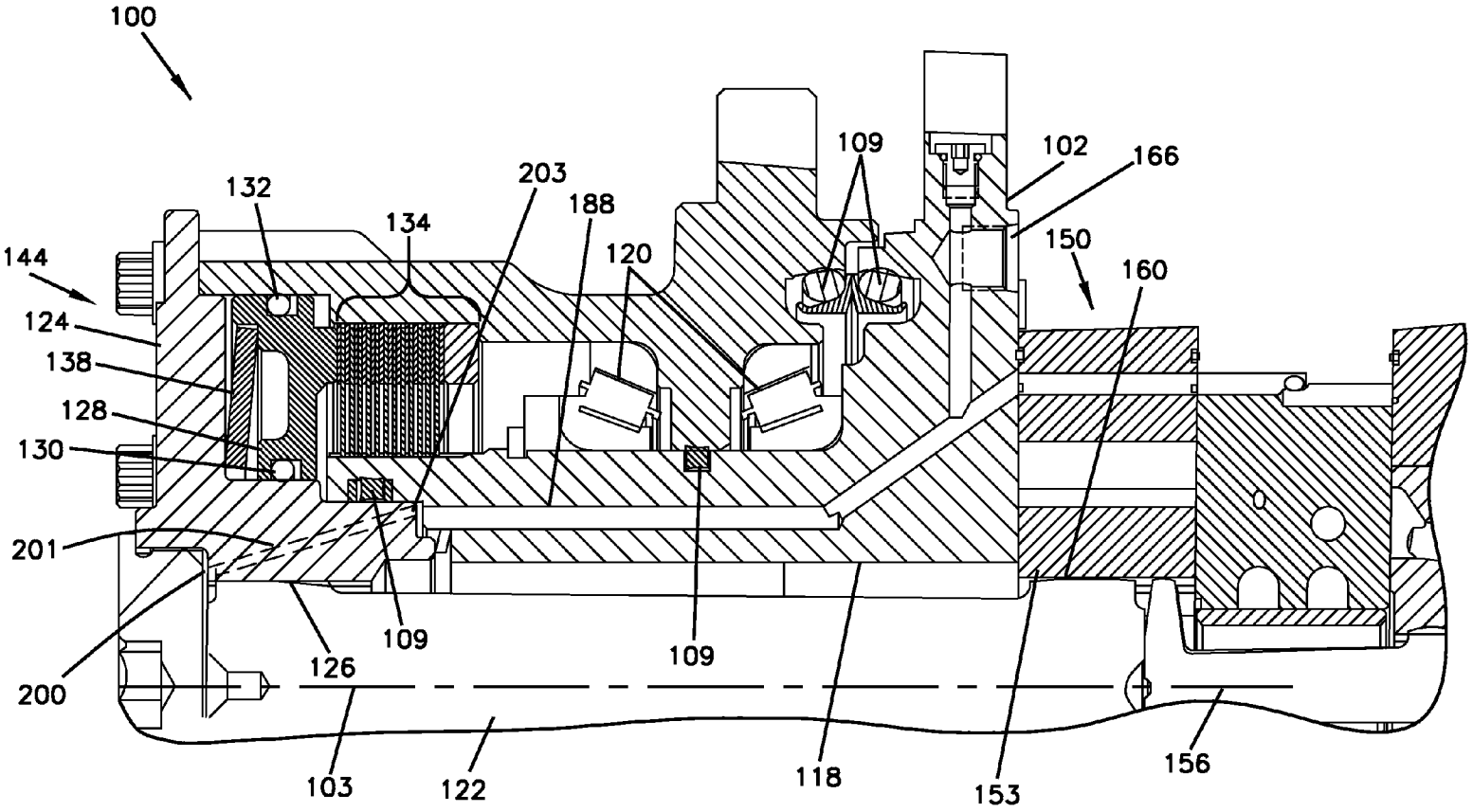
FIG. 9 is a cross-sectional view of a case drain cavity of the combined hydraulic motor and brake of FIG. 1.

The motor 142 of the combined hydraulic motor and brake assembly 100 may include a plurality of fluid ports, as shown in FIGS. 7-9. As is known in the art, the motor 142 may include one or more ports providing fluid inlets and/or outlets in communication with one or more portions of the interior of the motor 142. As is illustrated in FIG. 7 ports may include first and second main ports 162, 164. Ports 162, 164 may be inlet and/or outlet ports. Valve 143 controls fluid communication between a pump 178 and the ports 162, 164, and also controls fluid communication between the ports 162, 164 and a reservoir/tank 180. The pump 178 can be driven by a vehicle engine 176 or other engine. The valve 143 also has a neutral position that connects the pump 178 to the reservoir 180. In other embodiments, the valve can be configured to connect the ports 162, 164 to reservoir when in a neutral position. The valve 143 allows the motor 142 to be bi-directional. The motor 142 may further include a case drain port 166. Leaked or drained oil in the case is typically ported to the hydraulic reservoir tank 180, which is at low pressure, by use of a drain system employing internal valves within the case (e.g., shuttle valves, check valves, etc.). The motor 142 may include a brake release port 168. As is now well known to those skilled in the art, the hydraulic pressure to disengage the brake may be internal case pressure, or an external "pilot" pressure from a system charge pump 174, or any other suitable source of pressure. Charge pump 174 may be driven by the vehicle engine 176 and hydraulically coupled to the main pump 178. A controller 184 may at least partly control a control valve 182 fluidly connected to the brake release port 168 and/or, a high pressure side of the charge pump 174. The control valve 182 may be operable to selectively deliver pressurized fluid (e.g., charge or pilot pressure generated by the charge pump 174) to the brake release port 168. The motor 142 may also include a shift port 170. It is further contemplated that a combined hydraulic motor and brake assembly according to embodiments of the disclosure may include more or less ports than are shown in FIG. 7.

Referring to FIG. 8, passage 186 defined by the stationary housing 102 provides fluid communication between the brake release port 168 and the brake chamber 140. When the valve 182 opens fluid communication between the charge pump 174 and the brake release port 168, the passage 186 provides fluid communication between the brake release port 168 and the brake chamber 140. In this way, charge pressure is provided to the brake chamber 140 causing the piston 128 to move away from the brake pack 134 against the bias of the spring 138 to release the brake.

Referring to FIG. 9, passage 188 defined at least in part by the stationary housing 102 provides fluid communication between the case drain port 166 and an interior of the assembly forming a case drain region. In operation of the motor 142, case drain fluid (e.g., hydraulic oil) is shuttled from the motor 142 through splines 160 into the shaft opening 118. The case drain fluid then flows axially along the shaft opening 118, through splines 126 to a cavity 200 at the front end of the shaft 122. From the cavity 200, the case drain fluid flows through passage 201 defined by the coupler 124 to a cavity 203 at the rear of the coupler 124. From the cavity 203, the case drain fluid flows through the passage 188 to the case drain port 166. From the case drain port 166, case drain flow proceeds to reservoir 180.

The described embodiments may be implemented with any hydraulic device that includes a hydraulic motor and brake assembly. The described embodiments may also provide a smaller form-factor hydraulic motor and brake assembly, further decreasing costs and increasing design flexibility.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A combined hydraulic motor and brake comprising:

a stationary housing defining a shaft passage;

a driven hub;

a bearing positioned between the driven hub and the stationary housing for allowing the driven hub to rotate relative to the stationary housing about an axis of rotation that extends through the shaft passage;

a drive shaft that extends through the shaft passage of the stationary housing;

hydraulic motor for rotating the drive shaft relative to the stationary housing;

a coupler for coupling the drive shaft to the driven hub such that the coupler and the driven hub rotate as a unit about the axis of rotation when the drive shaft is rotated by the hydraulic motor;

a brake including a brake pack having first brake pads mounted to the stationary housing and second brake pads carried by the driven hub such that the second brake pads rotate relative to the first brake pads when the driven hub rotates relative to the stationary housing, the first and second brake pads being interleaved relative to one another;

a brake piston carried with the coupler and the driven hub when the coupler and driven hub are rotated about the axis of rotation;

an outer radial piston seal positioned between the brake piston and the driven hub;

an inner radial piston seal positioned between the brake piston and the coupler; and a spring for actuating the brake by applying a braking force through the brake piston to the brake pack to compress the first and second brake pads together such that relative rotation between the driven hub and the stationary housing is resisted by friction between the first and second brake pads, and wherein the brake is released by applying hydraulic pressure to the piston to generate a brake release force that opposes the braking force.

2. The combined hydraulic motor and brake of claim 1, wherein the hydraulic motor is a gerotor-type hydraulic motor including a rotor and a stator, wherein the drive shaft is coupled to the rotor.

3. The combined hydraulic motor and brake of claim 1, wherein the drive shaft is coupled to the coupler by a splined mechanical interface.

4. The combined hydraulic motor and brake of claim 1, wherein the coupler is coupled to the driven hub by a plurality of fasteners that are circumferentially spaced around the axis of rotation along a perimeter of the coupler.

5. The combined hydraulic motor and brake of claim 1, wherein the driven hub includes a plurality of first fastener openings for receiving first fasteners used to securing the driven hub to a driven element.

6. The combined hydraulic motor and brake of claim 5, wherein the stationary housing includes a mounting flange that projects radially outwardly from a main body of the stationary housing, the mounting flange defining a plurality of second fastener openings for receiving second fasteners used to secure the stationary housing to a non-driven/stationary element.

7. The combined hydraulic motor and brake of claim 6, wherein the non-driven/stationary element includes a portion of a vehicle frame.

8. The combined hydraulic motor and brake of claim 6, wherein the mounting flange is generally semi-circular in shape.

9. The combined hydraulic motor and brake of claim 6, wherein the driven hub includes a main body and a plurality of tabs that project radially outwardly from the main body, the tabs being circumferentially spaced around the axis of rotation along a perimeter of the main body of the driven hub, the first fastener openings being defined through the tabs.

10. The combined hydraulic motor and brake of claim 9, wherein the tabs are separated by pockets, and wherein at least some of the pockets align with the first fastener openings to facilitate accessing the first fastener openings.

11. A combined hydraulic motor and brake comprising:

a stationary housing defining a shaft passage for receiving a drive shaft;

a rotatable housing mounted at least partially over the stationary housing;

a hydraulic motor for rotating the drive shaft relative to the stationary housing;

a coupler for coupling the drive shaft to the rotatable housing; and a brake piston mounted between the rotatable housing and the coupler and frictionally engaged with the rotatable housing and the coupler such that the coupler, the rotatable housing and the brake piston are configured to rotate as a unit when driven by the drive shaft, the brake piston further including two or more sealing arrangements that remain substantially static as the brake piston rotates with the rotatable housing and the coupler;

wherein the brake piston is configured to actuate a brake assembly having first brake pads mounted to the stationary housing and second brake pads carried by the rotatable housing such that the second brake pads rotate relative to the first brake pads when the rotatable housing rotates relative to the stationary housing, the first and second brake pads being interleaved relative to one another.

12. The combined hydraulic motor and brake of claim 11, wherein the coupler is coupled to the rotatable housing by a plurality of fasteners that are circumferentially spaced around a perimeter of the coupler.

13. The combined hydraulic motor and brake of claim 11, further comprising a bearing positioned between the stationary housing and rotatable housing for allowing the coupler, the rotatable housing, and the brake piston to rotate relative to the stationary housing.

14. The combined hydraulic motor and brake of claim 11, wherein the two or more sealing arrangements comprise at least one outer radial piston seal positioned between the brake piston and the rotatable housing and at least one inner radial piston seal positioned between the brake piston and the coupler.

15. The combined hydraulic motor and brake of claim 11, further comprising a spring assembly for actuating the brake assembly by applying a braking force through the brake piston to the brake assembly to compress the first and second brake pads together such that relative rotation between the stationary housing and the rotatable housing is resisted by friction between the first and second brake pads.

16. The combined hydraulic motor and brake of claim 15, wherein the spring assembly is configured to rotate with the rotatable housing, the coupler and the brake piston.

17. The combined hydraulic motor and brake of claim 11, wherein the brake assembly is released by applying hydraulic pressure to the brake piston to generate a brake release force that opposes the braking force, and wherein releasing the brake assembly enables at least a portion of the brake assembly to rotate with the rotatable housing, the coupler, and the brake piston.

18. The combined hydraulic motor and brake of claim 11, further comprising a hydraulic motor for rotating the drive shaft relative to the stationary housing.

19. A combined hydraulic motor and brake comprising:

a stationary housing defining a shaft passage for receiving a drive shaft;

a rotatable housing mounted at least partially over the stationary housing;

a hydraulic motor for rotating the drive shaft relative to the stationary housing;

a coupler coupled to the rotatable housing;

a piston mounted between the rotatable housing and the coupler such that the coupler, the rotatable housing and the piston are configured to rotate as a unit when driven by the drive shaft, the piston further including two or more sealing arrangements that remain substantially static as the piston rotates with the rotatable housing and the coupler; and a spring-actuated brake including a brake pack having first brake pads mounted to the stationary housing and second brake pads carried by the rotatable housing such that the second brake pads rotate relative to the first brake pads when the rotatable housing rotates relative to the stationary housing, the first and second brake pads being interleaved relative to one another, the spring-actuated brake being configured to engage by receiving a spring-applied braking force directed through the piston to the brake pack to compress the first and second brake pads together such that relative rotation between the rotatable and stationary housings is resisted by friction between the first and second brake pads, and wherein the brake is released by applying hydraulic pressure to the piston to generate a brake release force that opposes the braking force.

20. A combined hydraulic motor and brake comprising:

a hydraulic motor including a hydraulic motor housing;

a drive shaft assembly that is driven by the hydraulic motor;

a stationary housing fixed relative to the hydraulic motor housing;

a rotatable housing that is rotatably driven about an axis of rotation by the drive shaft assembly;

a brake for resisting relative rotation between the rotatable housing and the stationary housing;

a piston that is hydraulically actuated to release the brake, the piston being carried with the rotatable housing such that the piston, the rotatable housing and at least a portion of the drive shaft assembly are configured to rotate as a unit about the axis of rotation;

wherein an outer diameter of the piston is sealed against the rotatable housing and an inner diameter of the piston is sealed against the portion of the drive shaft assembly.

21. The combined hydraulic motor and brake of claim 20, wherein the drive shaft assembly includes a drive shaft and a coupler, and wherein the coupler couples the drive shaft to the rotatable housing.

22. A combined hydraulic motor and brake comprising:

a stationary housing defining a shaft passage for receiving a drive shaft;

a rotatable housing mounted at least partially over the stationary housing;

a hydraulic motor for rotating the drive shaft relative to the stationary housing;

a coupler for coupling the drive shaft to the rotatable housing; and a brake piston mounted between the rotatable housing and the coupler and frictionally engaged with the rotatable housing and the coupler such that the coupler, the rotatable housing and the brake piston are configured to rotate as a unit when driven by the drive shaft, the brake piston further including two or more sealing arrangements that remain substantially static as the brake piston rotates with the rotatable housing and the coupler;

wherein the coupler is coupled to the rotatable housing by a plurality of fasteners that are circumferentially spaced around a perimeter of the coupler.

23. A combined hydraulic motor and brake comprising:

a stationary housing defining a shaft passage for receiving a drive shaft;

a rotatable housing mounted at least partially over the stationary housing;

a hydraulic motor for rotating the drive shaft relative to the stationary housing;

a coupler for coupling the drive shaft to the rotatable housing;

a brake piston mounted between the rotatable housing and the coupler and frictionally engaged with the rotatable housing and the coupler such that the coupler, the rotatable housing and the brake piston are configured to rotate as a unit when driven by the drive shaft, the brake piston further including two or more sealing arrangements that remain substantially static as the brake piston rotates with the rotatable housing and the coupler; and a bearing positioned between the stationary housing and rotatable housing for allowing the coupler, the rotatable housing, and the brake piston to rotate relative to the stationary housing.

24. A combined hydraulic motor and brake comprising:

a stationary housing defining a shaft passage for receiving a drive shaft;

a rotatable housing mounted at least partially over the stationary housing;

a hydraulic motor for rotating the drive shaft relative to the stationary housing;

a coupler for coupling the drive shaft to the rotatable housing; and a brake piston mounted between the rotatable housing and the coupler and frictionally engaged with the rotatable housing and the coupler such that the coupler, the rotatable housing and the brake piston are configured to rotate as a unit when driven by the drive shaft, the brake piston further including two or more sealing arrangements that remain substantially static as the brake piston rotates with the rotatable housing and the coupler;

wherein the two or more sealing arrangements comprise at least one outer radial piston seal positioned between the brake piston and the rotatable housing and at least one inner radial piston seal positioned between the brake piston and the coupler.

* * * * *